United States Patent [19]

Fjällström

[11] Patent Number: 4,706,816

[45] Date of Patent: Nov. 17, 1987

[54] MODULE PACKING SYSTEM FOR PACKING AND TRANSPORTING OF GOODS

[76] Inventor: Bengt Fjällström, Södra Kungsvägen 9, S-52200 Tidaholm, Sweden

[21] Appl. No.: 796,441

[22] Filed: Nov. 8, 1985

[30] Foreign Application Priority Data

Nov. 8, 1984 [SE] Sweden ..... 8405599

[51] Int. Cl.[4] ..... B65D 85/68

[52] U.S. Cl. ..... 206/525; 206/600; 206/386; 211/189; 220/4 F

[58] Field of Search ..... 206/386, 525, 600, 599, 206/335; 220/4 C, 4 D, 4 F; 312/253; 211/175, 189, 190; 108/52.1, 53.1, 53.3, 55.3, 137, 141

[56] References Cited

U.S. PATENT DOCUMENTS

| | | | |
|---|---|---|---|
| 1,585,752 | 5/1926 | Young | 211/189 |
| 2,866,676 | 12/1958 | Goebel | 312/253 |
| 3,830,380 | 8/1974 | Spencer | 206/600 |
| 3,927,764 | 12/1975 | Fox | 206/600 |
| 4,324,172 | 4/1982 | Cazals et al. | 220/4 F |
| 4,506,798 | 3/1985 | Goutille | 220/4 F |
| 4,512,473 | 4/1985 | Thomaswick et al. | 206/600 |

FOREIGN PATENT DOCUMENTS

| | | | |
|---|---|---|---|
| 1071533 | 2/1980 | Canada | 206/386 |
| 2616824 | 10/1977 | Fed. Rep. of Germany | 206/386 |
| 2506263 | 11/1982 | France | 206/386 |
| 823100 | 8/1983 | Sweden . | |
| 912051 | 12/1962 | United Kingdom | 206/386 |
| 1070074 | 1/1984 | U.S.S.R. | 206/386 |

*Primary Examiner*—William Price

*Assistant Examiner*—Brenda J. Ehrhardt

*Attorney, Agent, or Firm*—Wenderoth, Lind & Ponack

[57] ABSTRACT

A module packing system for packing and transporting goods especially work shop machines is built from standard details and includes bottom beams (1), vertical beams (2), horizontal side and/or upper beams (3), stays (10) and whole-threaded screws (5) with belonging nuts (9). The vertical and longitudinal dimensions of the module packing system can now be adjusted to accommodate the form of the goods intended to be packed. The invention is adjustable in a transverse direction by spacing bottom beams (1) on lower supporting means. Bottom beams (1) are mounted to bottom blocks (12), which include a bottom plate (13). On these plates (13) bits (15) of square tube are, for example, welded parallel to each other and with the bottom beams (1). These bits (15) are provided with holes (20) extending perpendicular to the bottom beams (1). The interspaces (19) between the bits (15) are adapted so that the bottom beams (1) can be brought into the spaces (19) to be attached at the bottom blocks (12) in desired positions. Furthermore, I- or T-formed beams are arranged as supports for the bottom blocks (12) and the entire module packing system. The bottom blocks (12) are movable along these I- or T-formed beams (14) in the transverse direction of the module packing and in a direction perpendicular to the bottom beams (1). The blocks are then locked at desired positions along the beams (14). Furthermore the goods (25) are attached in the inside of the module packing system beams (24) for fastening the goods (25) by screws, nuts and washers (27, 28, 29, 30).

6 Claims, 3 Drawing Figures

MODULE PACKING SYSTEM FOR PACKING AND TRANSPORTING OF GOODS

BACKGROUND OF THE INVENTION

1. Field of the Invention

The invention relates to a module packing system for packing and transporting goods. Particularly the invention relates to a module packing system for transporting heavier goods such as work shop machines.

2. Description of the Related Art:

Transport of, for example, machines etc. was earlier effected by means of simple pallets, which has resulted in that the products or the goods have been damaged during transport, which in turn caused large economical losses. Furthermore, often "tailor-built" boxes are manufactured, which are broken down after use and thrown away without being reused.

SUMMARY OF THE INVENTION

The module packing system according to the present invention includes a bottom section, side parts, upper beams, stay means and means for attaching goods at the bottom section via an arrangement of bottom blocks with belonging screws, nuts and washers. The bottom blocks in turn are arranged to be attached or fastened to lower transverse supporting beams. All these means are arranged for compressing the module packing to desired dimensions in transverse, longitudinal and vertical directions.

The module packing includes consequently a small number of earlier manufactured standard details, which can be adjusted using screws to a desired form depending on the desired use. The packing, accordingly, can be adapted to the form of the goods intended to be transported, whereby the goods also will be fastened or attached at the bottom section of the inner side of the packing. The module packing itself includes such module or standard details as bottom beams, horizontal side beams and stay means.

The object or objects of the present invention in this application include providing a completely adjustable packing in which module or standard details such as bottom blocks, I- or T-formed supporting beams with belonging locking nuts, nuts, whole-threaded screws and washers are used. All these details are arranged for compressing the module packing in longitudinal and transverse directions all according to the form of the goods intended for packing. Screws and nuts are arranged for attaching of the bottom blocks in a transverse direction along the I- or T-formed beams.

The module packing system will now be described in detail with reference to the appended drawings, where one form of the module packing system according to the invention is shown only only as an example and not in the aim of limiting the scope of the invention.

DESCRIPTION OF THE PREFERRED EMBODIMENT

Figure 1:
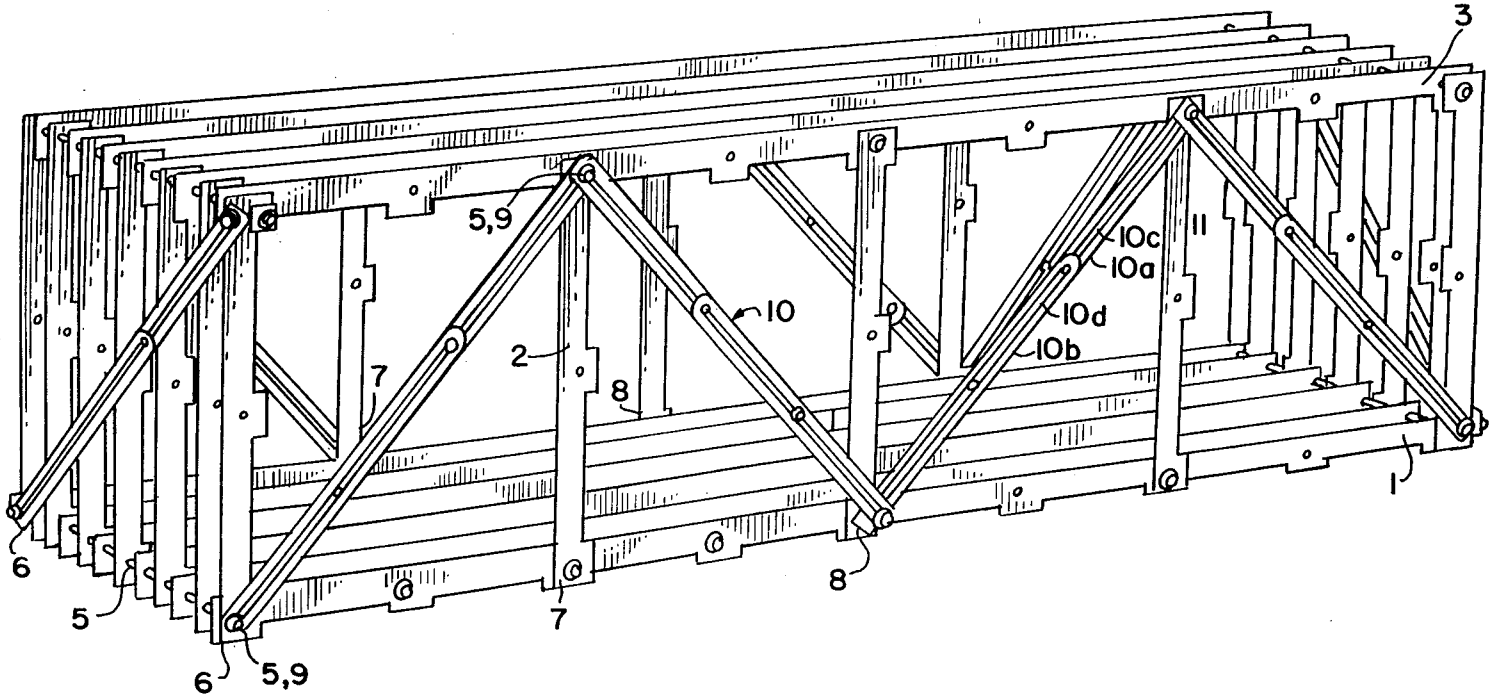
FIG. 1 is a perspective view showing a part of the bottom beams, vertical beams, upper beams and stays and means for compressing this module packing system in transverse, longitudinal and vertical directions as desired, according to the form of the goods.

In FIG. 1 (and also in FIG. 2 and FIG. 3) a number of horizontal and longitudinal bottom beams are denoted by reference numeral 1. A number of vertically arranged beams are denoted by 2. Horizontally and longitudinally arranged upper beams are denoted by 3. These standard elements, which consist preferably of wood, comprise a parallelly arranged frame structure (FIG. 1), whereby corresponding junctures 6, 7, 8 in the outer framed structure are connected with each other via the bottom beams 1. In the vertical beams 2 and in the upper beams 3 are holes through which whole-threaded screws 5 with belonging nuts 9 extend. Consequently, the screws 5 are arranged to extend through the holes in the beam 1 of the parallelly arranged frame structure.

The vertical beams 2 of the frame structure of the module packing system can be brought to a desired inclination relative to the bottom beams to accommodate the form of the goods being surrounded, whereafter the packing can be locked in this position by means of screw 5, nuts 9 and stays 10. Each of the stays 10 includes two separate bars of longitudinal elements 10*a*, 10*b*, which are provided with longitudinal slots 10*c*, 10*d* for receiving locking screws 11. By moving the bars 10*a*, 10*b* towards or away from each other the stay 10 is brought to a desired length corresponding to the position in which they are to be locked by means of the locking screws 11.

Figure 2:
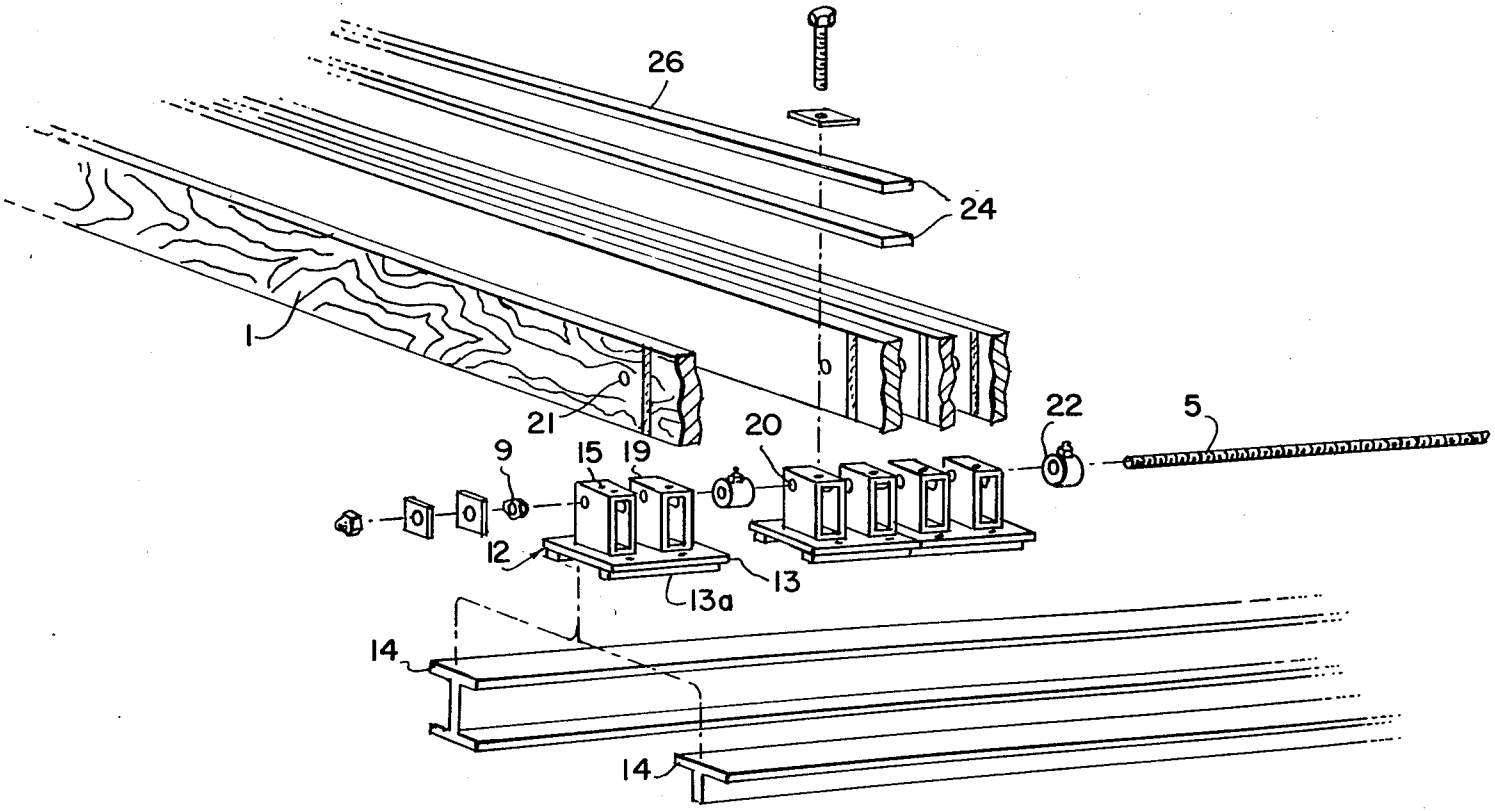
FIG. 2 is an assembly view showing details of the bottom part of the module packing system such as bottom blocks with bottom plates, bottom beams, screws and nuts, means for securing the module packing system together as well as means for attaching the goods to the module packing system and I-or T-formed beam lower supports for the packing extending in a transverse direction.
Figure 3:
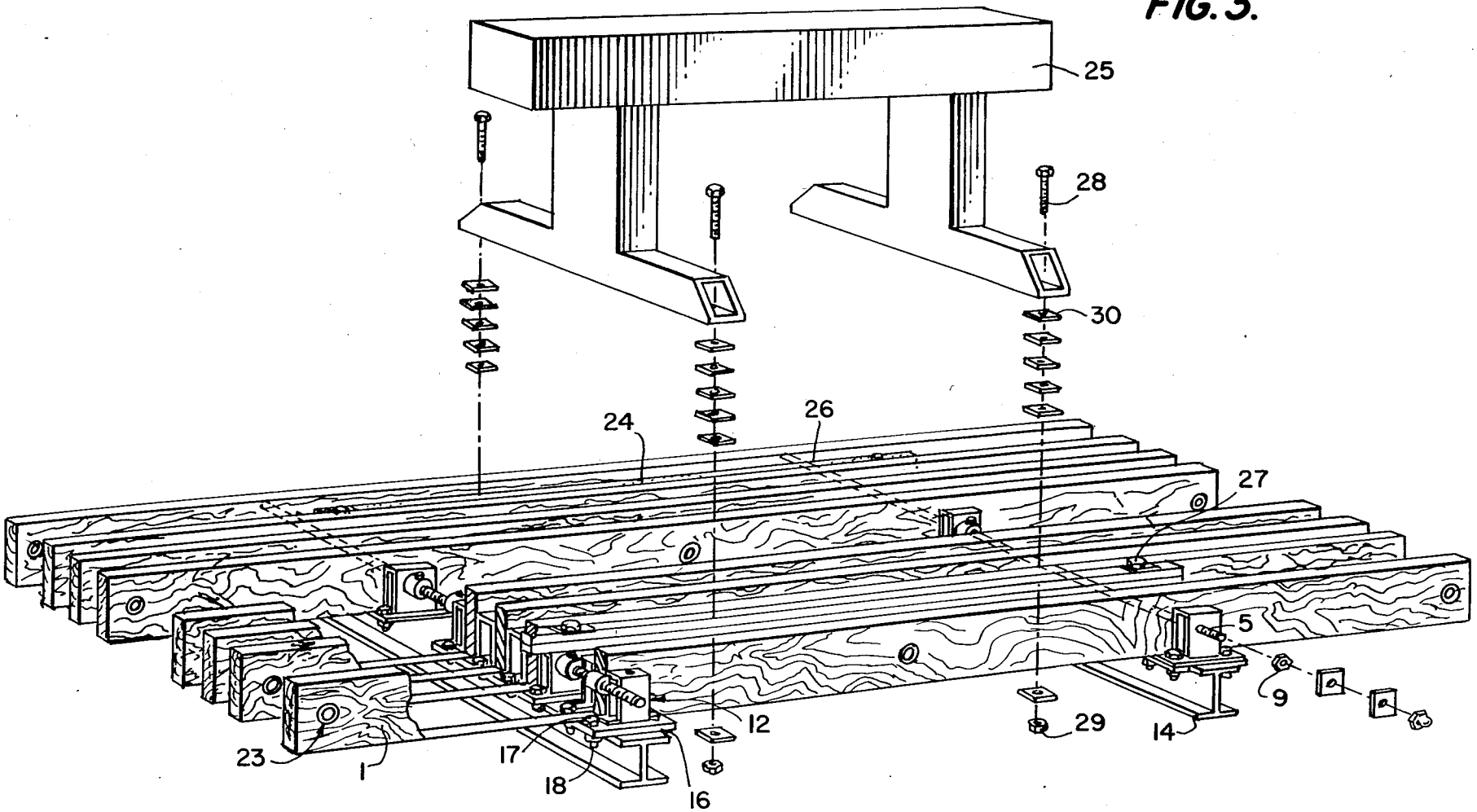
FIG. 3 is a view showing the bottom part shown in FIG. 2 in an assembled state. Here, however, a good to be packed is shown in the form of a table to be attached to the longitudinal beams provided with slots.

The earlier part of this description describes how to vary the dimension of the module packing system in the longitudinal direction. To vary the dimension of the packing in the transverse direction to accommodate the form or extension of the goods intended for packing, the distance between the bottom beams 1 in the bottom section of the module packing is varied by a compressing means. This is accomplished by bottom blocks 12 (FIG. 2 and FIG. 3). Each of the bottom blocks 12 includes a bottom plate 13, which is provided with flanges 13*a*. Above the plates 13 a number of square tubes 15 are arranged, preferably welded parallel to each other, on each plate 13. Those bottom blocks 12 are mountable at positions along the transverse direction of the bottom beams 1 with arranged I- or T-formed supporting beams 14 (preferably of steel) by screws 17, washers 16, flanges 13*a* and nuts 18 (FIG. 3), and in a desired position along the longitudinal direction of the I- or T-formed supporting beams 14. The distances between the square tubes 15 are adjusted so that the bottom beams 1 can be brought in to the interspace 19 between the tubes 15. The dimension of the interspace 19 is slightly larger than the thickness of the bottom beams 1. Therefore, the bottom beams 1 can be brought into the space 19 between the square tubes 15. The bottom blocks 12 are arranged level with each other and at least in two paths in the transverse direction under the bottom beams 1. Furthermore the square tubes 15 of the blocks 12 are provided with holes 20, which extend perpendicular to the interspaces 19. Also, the bottom beams 1 in the bottom section of the packing are provided with holes 21, which are arranged at modulated distances along the bottom beams 1 which may be aligned with the holes 20. Locking nuts 22 are threaded on the whole-threaded screws 5, which nuts at the arranging of the module packing can be provided between the bottom blocks 12 or outside of them for controlling or fixing of the distance between the bottom beam 1 or groups of bottom beams 1 and for preventing the screws from sliding from the predetermined position. Each of the holes in the bottom beams 1 consisting of wood are provided with bits of tube elements 23, preferably of steel, to prevent the holes 21 from wearing so as to keep their original form for a long time. When building the module packing system, the whole-threaded screws 5 are threaded through the holes 20 in the bottom blocks 12 and the holes 21 in the bottom beams 1, whereby the screw 5 will extend through the whole bottom section of the module packing system in its transverse direction. The blocks 12 are then fastened or attached in desired positions, depending on the form of the goods, on the I- or T-formed supporting beams 14 by means of the screws 17, nuts 18 and washers 16. After that, the bottom beams 1 in the module packing system are attached in desired positions to the bottom blocks 12 by means of the screws 5, nuts 9 and the locking nuts 22. The bottom blocks 12, the transversely arranged supporting beams 14, the bottom beams 1 and the whole-threaded screws 5 with the belonging nuts 9 support the whole packing system. Hereby, a stability is achieved both in the transverse and longitudinal directions of the module packing system. The bottom beams 1 will, in a very effective manner, be locked in their positions and will not in any way be displaced in relation to each other in the transverse or longitudinal directions of the module packing system.

Also the goods 25, intended to be packed, are attached to the bottom section of the module packing system. For this purpose beams 24 (FIG. 2 and FIG. 3) of suitable module lengths are arranged. These beams 24 are provided with slots. The beams 24, provided with slots 26, are screwed or fastened by their ends above suitably chosen square tubes 15 by screws 27.

Finally the goods 25 are screwed to the beams 24 in the slots 26 by bolts 28, nuts 29 and washers 30. A suitable number of washers are used to control the distance between the beams 24 and the goods 25 because the goods 23 rest on the bottom beams 1. Sheets, for example veneer sheets or other suitable materials, can be used for covering the whole module packing system.

The compressing means and the other means in the bottom section of the module packing system as well as the locking and fastening means can be modified in many ways without departing from the scope of the invention, and are limited only by the appended claims.

I claim:

1. A module packing system for packing and transporting heavy goods, said system comprising:

an adjustable frame having a plurality of parallel spaced apart bottom beams defining a bottom portion of said system, a plurality of parallel spaced apart upper beams defining an upper portion of said system, said plurality of parallel upper beams extending parallel to said plurality of parallel bottom beams and spaced from said bottom beams in a direction perpendicular to the direction in which said upper beams and said bottom beams extend, and a plurality of vertical beams each of which is pivotably attached at a first end thereof to a respective one of said bottom beams and at a second end thereof to a respective one of said upper beams;

stay means attached to said frame for adjusting and for fixing the inclination of said vertical beams relative to said plurality of upper beams and bottom beams thereby allowing the distance between which said plurality of upper beams are spaced from said plurality of bottom beams to be adjustable; and adjustment means attached to said frame for fixing each of said plurality of bottom beams in position, said adjustment means being adjustable for allowing the spacing between said plurality of bottom beams to be adjusted thereby allowing said frame to be adjustable in size in a dimension corresponding to a direction that is transverse to the direction in which said plurality of bottom beams and upper beams extend.

2. A modular packing system as claimed in claim 1 wherein, said stay means comprises at least one stay beam adjustably mounted on said frame.

3. A modular packing system for packing and transporting heavy goods, said device comprising:

an adjustable frame having a plurality of parallel spaced apart bottom beams defining a bottom portion of said system, a plurality of parallel spaced apart upper beams defining an upper portion of said system, said plurality of parallel upper beams extending parallel to said plurality of parallel bottom beams and spaced from said bottom beams in a direction perpendicular to the direction in which said upper beams and said bottom beams extend, and a plurality of vertical beams each of which is attached at a first end thereof to a respective one of said bottom beams and at a second end thereof to a respective one of said upper beams;

adjustment means attached to said frame for fixing each of said plurality of bottom means in position relative to one other, said adjustment means being adjustable for allowing the spacing between adjacent ones of said plurality of bottom beams to be adjusted thereby allowing said frame to be adjustable in size in a dimension corresponding to a direction that is transverse to the direction in which said plurality of bottom beams and upper beams extend, said adjustment means comprising a plurality of blocks to which said plurality of bottom beams are mounted, and each of said blocks comprising a flange on which at least one of said plurality of bottom beams lies, a guide on the bottom of said flange for engaging a supporting beam extending in said transverse direction, two support means fixed to and extending from said flange on opposite sides of said at least one bottom beam for supporting said at least one bottom beam, and securing means for adjustably mounting said block on the supporting beam in said transverse direction.

4. A module packing system as claimed in claim 3, wherein said plurality of bottom beams have at least one set of aligned holes each of which extends through a respective one of said plurality of bottom beams in said transverse direction;

each of said support means has a hole extending therethrough aligned with the hole of said set extending through said at least one bottom beam of said plurality of bottom beams which said support means supports; and said adjustment means further comprises a screw extending through each set of said at least one set of aligned holes in said plurality of bottom beams and said holes aligned therewith in said support means.

5. A module packing system as claimed in claim 3, wherein said securing means comprises screws, nuts and washers for securing said flange to the support beam.

6. A module packing system as claimed in claim 3 and further comprising, attaching means for securing the goods to said bottom beams, said attaching means comprising at least one goods securing beam extending parallel to and between two adjacent ones of said plurality of bottom beams, said at least one goods securing beam having a slot therethrough extending in the longitudinal direction thereof parallel to said plurality of bottom beams, and fastening means extending through said slot for securing said at least one goods securing beam to said support means of said block.

* * * * *